US006232828B1

(12) United States Patent
Smith et al.

(10) Patent No.: US 6,232,828 B1
(45) Date of Patent: May 15, 2001

(54) BANDGAP-BASED REFERENCE VOLTAGE GENERATOR CIRCUIT WITH REDUCED TEMPERATURE COEFFICIENT

(75) Inventors: Gregory J. Smith; Yinming Chen, both of Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/368,104

(22) Filed: Aug. 3, 1999

(51) Int. Cl.[7] ..... G05F 1/10
(52) U.S. Cl. ..... 327/539; 323/313
(58) Field of Search ..... 327/539, 512, 327/513, 540; 323/313, 312

(56) References Cited

U.S. PATENT DOCUMENTS

| | | | | |
|---|---|---|---|---|
| 4,249,122 | * | 2/1981 | Widlar | 323/313 |
| 4,808,908 | * | 2/1989 | Lewis et al. | 323/313 |
| 5,126,653 | | 6/1992 | Ganesan et al. | 323/313 |
| 5,291,122 | | 3/1994 | Audy | 323/313 |
| 6,075,354 | * | 6/2000 | Smith et al. | 323/313 |

OTHER PUBLICATIONS

Bang–Sup Song and Paul R. Gray, "A Precision Curvature–Compensated CMOS Bandgap Reference", IEEE Journal of Solid–State Circuits, vol. SC–18, No. 6, Dec. 1983, pp. 634–643.

Carl R. Palmer and Robert C. Dobkin, ISSCC 81/Wednesday, Feb. 18, 1981, IEEE International Solid–State Circuits Conference, Digest of Technical Papers, "A Curvature Corrected Micropower Voltage Reference", pp. 58 and 59.

Data Sheet for Analog Devices, 1999, "Precision Micropower, Low Dropout, Voltage References", pp. 1–23.

Robert A. Pease, ISSCC 84/Friday, Feb. 24, 1984, IEEE International Solid–State Circuits Conference, Digest of Technical Papers, "A Fahrenheit Temperature Sensor", pp. 292 and 293.

* cited by examiner

*Primary Examiner*—Jung Ho Kim
(74) *Attorney, Agent, or Firm*—Baker & McKenzie

(57) ABSTRACT

A bandgap-based reference voltage generator circuit with an increased output reference voltage and a reduced temperature coefficient uses a curvature correction bias voltage to significantly reduce the degree of variation of the bandgap-based reference voltage over temperature. A current having a negative temperature coefficient is conducted by a resistor having a positive temperature coefficient. The resultant voltage across the resistor has an arcuate voltage-versus-temperature characteristic with a direction of incurvature that is substantially opposite the direction of incurvature of the corresponding arcuate voltage-versus-temperature characteristic of the voltage generated by a conventional bandgap reference voltage generator circuit. These voltages are summed together to produce a bandgap-based reference voltage which is greater in magnitude than a conventional bandgap reference voltage and has a significantly reduced temperature coefficient.

24 Claims, 5 Drawing Sheets

BANDGAP-BASED REFERENCE VOLTAGE GENERATOR CIRCUIT WITH REDUCED TEMPERATURE COEFFICIENT

BACKGROUND OF THE INVENTION

1. Field of the Invention

The present invention relates to bandgap reference voltage generator circuits, and in particular, to bandgap-based reference voltage generator circuits with compensation for reducing the temperature coefficient.

2. Description of the Related Art

Electronic systems which require a precision reference voltage typically use a bandgap voltage reference circuit, which is advantageously capable of operating with a low power supply potential. As is well known, the basic principle of a bandgap voltage reference circuit is based upon the summation of the negative temperature drift of the base-emitter voltage (Vbe) of a bipolar junction transistor with an appropriate magnitude of a positive temperature drift of a thermal voltage (Vt) in order to achieve a net zero temperature drift sum.

Referring to FIG. 1, a conventional bandgap reference circuit includes two bipolar junction transistors Q2, Q3 biased by a voltage divider circuit composed of resistors R1, R2, R3 and a diode-connected transistor Q1 and a current sinking circuit IS. The size of the emitter area of transistor Q2 is ten times the size of the emitter area of transistor Q3. The collector currents of these transistors Q2, Q3 are amplified differentially by a differential transconductance amplifier which produces the bandgap reference voltage Vbg (Vref), which, in turn, drives the voltage divider circuit. The diode-connected transistor Q1 introduces a voltage into the voltage divider circuit which has a negative temperature coefficient. The difference between the base-emitter voltages Vbe of transistors Q2, Q3 (ΔVbe=Vbe(Q3)−Vbe(Q2)) has a positive temperature coefficient. The value of the resulting bandgap voltage Vbg (Vref) can be determined in accordance with Equation 1:

$$Vref = Vbg = V_{be-Q_1} + \left(1 + \frac{R_1 + R_3}{R_2}\right)\Delta V_{be} \quad (1)$$

Where $$\Delta V_{be} = V_{be-Q_3} - V_{be-Q_2} = \frac{kT}{q}\ln A,$$

$$V_{be-Q_1} = \frac{kT}{q}\ln\frac{IE1}{IES},$$

$$k/q = 8.6167\times 10^{-5}$$

$$I_{ES} = RT^m e^{\frac{-qV_{G0}}{kT}},$$

$$I_{E1} = \frac{\Delta V_{be}}{R_2}$$

Equation 1 can be rearranged and written as Equation 2:

$$Vbg = V_{G0} + \frac{kT}{q}\left[\left(1 + \frac{R_1 + R_3}{R_2}\right)\ln A + \ln k \ln\frac{A}{qRR_2} - (m-1)\ln T\right] \quad (2)$$

To establish a zero temperature coefficient (OTC) at the expected operating temperature ($T_0$) Equation 2 is differentiated and set equal to zero. This produces Equations 3 and 4:

$$\left.\frac{\partial Vbg}{\partial T}\right|_{T=T_0} = \frac{k}{q}\left[\left(1 + \frac{R_2 + R_3}{R_2}\right)\ln A + \ln k \ln\frac{A}{qRR_2} - (m-1)\ln T\right] + \left.\frac{kT}{q}\left[\frac{m-1}{T}\right]\right|_{T=T_0} = 0 \quad (3)$$

$$\left(1 + \frac{R_1 + R_3}{R_2}\right)\ln A = (m-1) - \ln k \ln\frac{A}{qRR_2T^{m-1}} \quad (4)$$

Substituting Equation 4 into Equation 2 produces Equation 5 which defines the reference voltage Vref:

$$Vref = Vbg = V_{G0} + \frac{kT}{q}(m-1) - \frac{kT}{q}(m-1)\ln\frac{T}{T_0} \quad (5)$$

Referring to FIG. 2, the reference voltage Vref with respect to temperature T is graphed in accordance with Equation 5. From this graph it can be seen that, assuming a bandgap energy voltage $V_{G0}$=1.12 V, a constant m=5, an emitter-base junction constant of R=0.2818, an emitter area ratio A=10 and an operating temperature $T_0$=20° C., the reference voltage Vref has a temperature coefficient of approximate 12.6 ppm/° C.

However, as the precision requirements for the operating characteristics of modem electronic systems increase, particular as the magnitude of the available power supply voltage decreases, temperature coefficients of such magnitude become increasingly unacceptable. Accordingly, it would be desirable to have a bandgap-based reference voltage generator circuit with compensation which provides for significantly reduced temperature coefficients. Additionally, it would be further desirable to be able to adjust such compensation and provide for such compensation using standard semiconductor processing techniques.

SUMMARY OF THE INVENTION

A bandgap-based reference voltage generator circuit in accordance with the present invention provides an increased output reference voltage and a reduced temperature coefficient. Such a circuit uses circuit components commonly available with standard semiconductor processing techniques. A temperature coefficient curvature correction voltage is generated based upon an IR (current times resistance) voltage drop. The resistance R exhibits a natural curvature over temperature and nonlinear cross products of the IR voltage drop provide for fine tuning of such curvature. This curvature correction voltage is provided as a separate and independent bias voltage that is introduced externally to a standard bandgap reference voltage generator circuit, thereby providing a simpler solution than those in which components with high temperature coefficients are integrated internally to the bandgap reference voltage generator circuit. This correction voltage can be turned off without adversely affecting standard bandgap circuit operation, and the first order temperature coefficient of the correction voltage curvature can be adjusted to be sufficiently minimized so as to not skew the temperature coefficient operation of the standard bandgap circuit. This is done by selecting the temperature coefficient of the current (TCI) to be the approximate inverse (−TCR) of the temperature coefficient for the resistor (TCR), thereby making the overall current-times-resistance (IR) temperature coefficient extremely low.

In accordance with one embodiment of the present invention, a bandgap-based reference voltage generator circuit with an increased output reference voltage and a reduced temperature coefficient includes a bandgap voltage generator circuit and a control voltage generator circuit. The bandgap voltage generator circuit is configured to receive a bandgap-based reference voltage and a curvature correction control voltage and in accordance therewith provide the bandgap-based reference voltage with a first arcuate voltage-versus-temperature characteristic having a first direction of incurvature. The control voltage generator circuit, coupled to the bandgap voltage generator circuit, is configured to provide the curvature correction control voltage with a second arcuate voltage-versus-temperature characteristic having a second direction of incurvature which is substantially opposite the first direction of incurvature.

In accordance with another embodiment of the present invention, a bandgap-based reference voltage generator circuit with an increased output reference voltage and a reduced temperature coefficient includes: a bias voltage generator circuit; a voltage divider circuit; first and second circuit branches; a differential amplifier circuit; a current source circuit; and a resistive circuit element. The bias voltage generator circuit is configured to receive a curvature correction control voltage and in accordance therewith provide a bias voltage, wherein a voltage difference between the curvature correction control voltage and the bias voltage has a negative temperature coefficient. The voltage divider circuit, coupled to the bias voltage generator circuit, is configured to receive the bias voltage and a bandgap-based reference voltage and in accordance therewith provide first and second intermediate voltages. The first and second circuit branches, coupled to the voltage divider circuit, are configured to receive the first and second intermediate voltages and in accordance therewith conduct first and second substantially equal branch currents at first and second substantially unequal current densities and provide first and second branch voltages, respectively, wherein a voltage difference between the first and second intermediate voltages has a positive temperature coefficient. The differential amplifier circuit, coupled to the first and second circuit branches and the voltage divider circuit, is configured to receive the first and second branch voltages and in accordance therewith provide the bandgap-based reference voltage. The current source circuit is configured to provide a control current with a negative temperature coefficient. The resistive circuit element, having a resistance with a positive temperature coefficient and coupled to the current source circuit and the bias voltage generator circuit, is configured to receive the control current and in accordance therewith provide the curvature correction control voltage. The bandgap-based reference voltage has a first arcuate voltage-versus-temperature characteristic with a first direction of incurvature and the curvature correction control voltage has a second arcuate voltage-versus-temperature characteristic with a second direction of incurvature which is substantially opposite the first direction of incurvature.

These and other features and advantages of the present invention will be understood upon consideration of the following detailed description of the invention and the accompanying drawings.

DETAILED DESCRIPTION OF THE INVENTION

Figure 1:
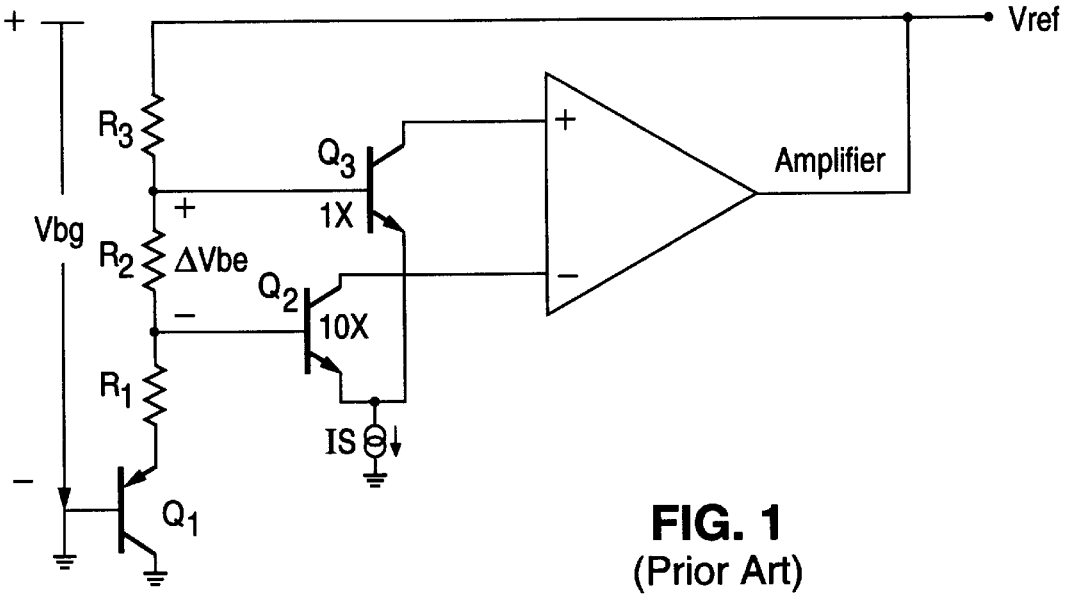
FIG. 1 (Prior Art)
FIG. 1 is a circuit schematic of a conventional bandgap reference voltage generator circuit.
Figure 3:
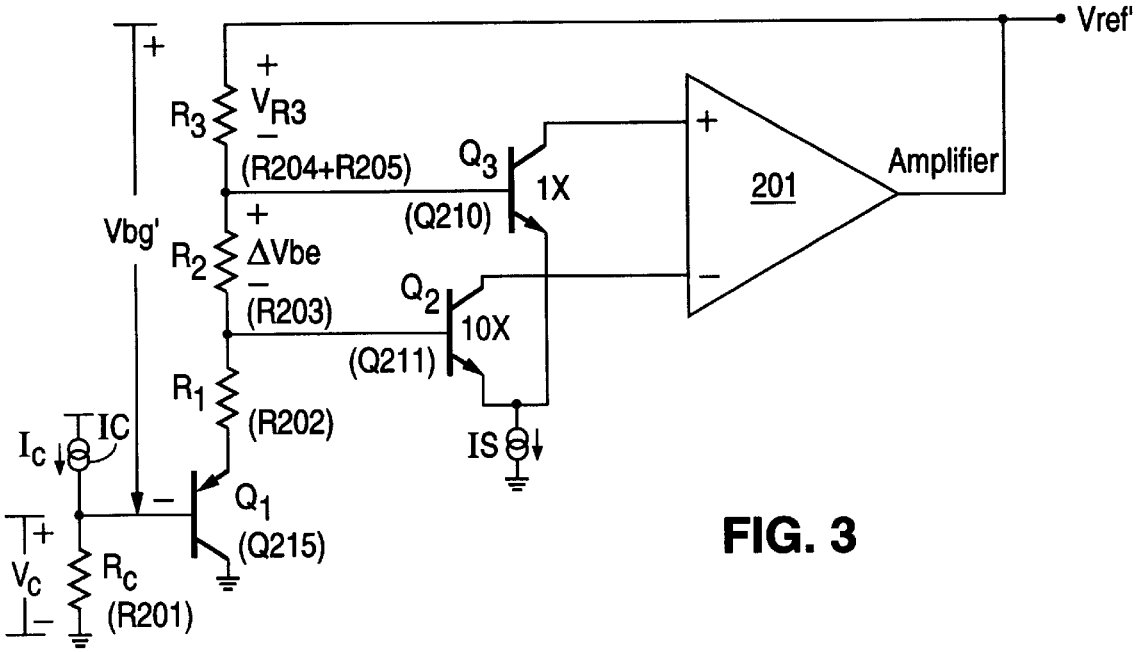
FIG. 3 is a circuit schematic of a bandgap-based reference voltage generator circuit with an increased output reference voltage and a reduced temperature coefficient in accordance with one embodiment of the present invention.

Referring to FIG. 3, a bandgap-based reference voltage generator circuit in accordance with one embodiment of the present invention introduces a curvature correction voltage generator in the form of a current source IC and resistor $R_C$ for driving the base of transistor Q1 as shown. (One example of the current source circuit IC which is well suited for providing the bias current $I_C$ is the subject of commonly assigned, co-pending U.S. patent application Ser. No. 09/368,321, entitled "Low Voltage Circuit For Generating Current With A Negative Temperature Coefficient," filed on even date herewith, the disclosure of which is incorporated herein by reference. A proper selection of the magnitude for the bias current $I_C$ and the curvature correction resistor $R_C$, which should be a resistor having a non-linear temperature coefficient, provides a voltage $V_C$ that has a voltage with a voltage-versus-temperature characteristic having a substantially equal but opposite direction of incurvature, or inflection, as the reference voltage Vbg'. This voltage $V_C$ is added to the "quasi" bandgap voltage Vbg'. Assuming a resistance $R_C$ as defined below, the correction voltage $V_C$ can be determined in accordance with Equation 6:

$$R_C=R_{C0}(1+TC_{1-R}\bullet T+TC_{2-R}\bullet T^2)\text{and } I_C=I_{C0}(1+TC_{1-1}\bullet T),$$

$$V_C=I_C\bullet R_C=I_{C0}(1+TC_{1-1}\bullet T)R_{C0}(1+TC_{2-R}\bullet T^2) \quad 6$$

Equation 6 can be expanded to produce Equation 7:

$$V_C=I_{C0}R_{C0}(1+TC_{1-R}\bullet T+TC_{2-R}T^2TC_{1-1}\bullet T+(TC_{1-1}\bullet TC_{1-R})\bullet T^2+TC_{1-1}\bullet TC_{1-1}\bullet TC_{2-R}\bullet T^3) \quad 7$$

Disregarding the third order term in Equation 7 produces Equation 8:

$$V_C=I_{C0}R_{C0}[1+(TC_{1-R}+TC_{1-1})T+(TC_{2-R}+TC_{1-1}\bullet TC_{1-R})T^2] \quad 8$$

Differentiating this expression for the correction voltage $V_C$ with respect to temperature produces Equations 9 and 10:

$$\frac{\partial V_C}{\partial T}=I_{C0}R_{C0}[(TC_{1-R}+TC_{1-I})+2(TC_{2-R}+TC_{1-I}\cdot TC_{1-R})T] \quad 9$$

$$\frac{\partial^2 V_C}{\partial T^2}=I_{C0}R_{C0}[2(TC_{2-R}+TC_{1-I}\cdot TC_{1-R})] \quad 10$$

Defining the correction voltage $V_{C0}$ at the desired operating temperature $T_0$ being equal to the product of a corresponding bias current $I_{C0}$ and $R_{C0}$ (i.e., $V_{C0}=I_{C0}R_{C0}$) and expanding Equation 8 in accordance with a Taylor Series produces Equation 11:

$$V_C(T_0+\Delta T)=V_C(T_0)+(\Delta T)V_{C0}[TC_{1-R}+TC_{1-1})+2(TC_{2-R}+TC_{1-1}\bullet TC_{1-R})T_0]+\tfrac{1}{2}(\Delta T)^2\bullet V_{C0}[2(TC_{2-R}+TC_{1-1}\bullet TC_{1-R})]+ \quad 11$$

Additionally, Equation 5 can also be expanded using a Taylor Series to produce Equation 12:

$$Vbg(T_0+\Delta T)=Vbg(T_0)+(\Delta T)\cdot\left.\frac{\partial Vbg}{\partial T}\right|_{T=T_0}+\frac{1}{2}(\Delta T)^2\cdot\left.\frac{\partial^2 Vbg}{\partial T^2}\right|_{T=T_0}+\cdots \quad 12$$

Ignoring those terms of Equations 11 and 12 which are higher than second order produces Equation 13 and 14:

$$V_C(T_0+\Delta T)+V_C(T_0)+(\Delta T)V_{C0}[(TC_{1-R}+TC_{1-1})+2(TC_{2-R}+TC_{1-1}\bullet TC_{1-R})T_0]+\tfrac{1}{2}(\Delta T)^2\bullet V_{C0}[2(TC_{2-R}+TC_{1-1}\bullet TC_{1-R})]+ \quad 13$$

$$Vbg(T_0+\Delta T)=Vbg(T_0)+\frac{kT_0}{q}(m-1)-\frac{1}{2}\frac{kT_0}{q}(m-1)\left(\frac{\Delta T}{T_0}\right)^2 \quad 14$$

From FIG. 3 it is known that the voltage $V_{R3}$ across resistor $R_3$ is as defined in Equation 15:

$$V_{R3}=\frac{\Delta Vbe}{R_2}\cdot R_3=(Vt\ln A)\cdot\frac{R_3}{R_2}=\left(\frac{k}{q}\ln A\right)\frac{R_3}{R_2}\cdot T \quad 15$$

Expanding Equation 15 produces Equation 16:

$$V_{R3}(T_0+\Delta T)=\left(\frac{k}{q}\ln A\right)\frac{R_3}{R_2}T_0+\left(\frac{k}{q}\ln A\right)\cdot\frac{R_3}{R_2}\cdot\Delta T \quad 16$$

If the value of resistor $R_3$ in Equation 16 is adjusted so as to cancel the first order term (i.e., the slope) in Equation 13 and substituting for resistor $R_{C0}(R_{Z0}=V_{C0}/I_{C0})$, also in Equation 13, so as to cancel the second order term in Equation 14, a flat reference voltage Vref can be produced. This produces Equations 17, 18, 19 and 20:

$$\begin{cases} V_{C0}[(TC_{1-R}+TC_{1-l})+2(TC_{2-R}+TC_{1-l}\cdot TC_{1-R})T_0]=-\left(\frac{k}{q}\ln A\right)\Delta\frac{R_3}{R_2} & 17 \\ \frac{1}{2}\frac{kT_0}{q}(m-1)\frac{1}{T_0^2}=\frac{1}{2}V_0[2(TC_{2-R}+TC_{1-l}\cdot TC_{1-R})] & 18 \end{cases}$$

$$\begin{cases} \Delta R_3=-\dfrac{V_0(TC_{1-R}+TC_{1-l})+2(TC_{2-R}+TC_{1-l}\cdot TC_{1-R})}{\{[(k/q)\cdot\ln A]/R_2\}} & 19 \\ R_{C0}=\dfrac{V_{C0}}{I_{C0}}=\dfrac{(k/q)(m-1)}{2T_0(TC_{2-R}+TC_{1-l}\cdot TC_{1-R})I_0} & 20 \end{cases}$$

Accordingly, the "quasi" bandgap voltage Vbg' and the bandgap-based reference voltage Vref (FIG. 3) can be determined using Equations 21 and 22.

$$Vbg'=Vbg+\Delta V_{R3} \quad 21$$

$$Vref'=Vbg'+V_C \quad 22$$

The term $\Delta V_{R3}$ is the adjustment voltage across resistor R3 used to cancel the first order term (slope) of the correction voltage $V_C$. Rearranging the foregoing equations to solve for the bandgap-based reference voltage Vref produces Equation 23:

$$Vref'(T+\Delta T)=Vbg(T_0)+\frac{kT_0}{q}(m-1)+V_C(T_0)+\left(\frac{k}{q}\right)\ln A\cdot\frac{\Delta R_3}{R_2} \quad 23$$

The term $\Delta R_3$ is the differential resistance of resistor $R_3$ before and after adding the curvature correction voltage $V_C$. (As will be seen in more detail below, this differential resistance for $R_3$ can be achieved by splitting the resistor $R_3$ into two series resistances and tapping off an appropriate amount of current from the node intermediate to such resistances.)

Figure 4:
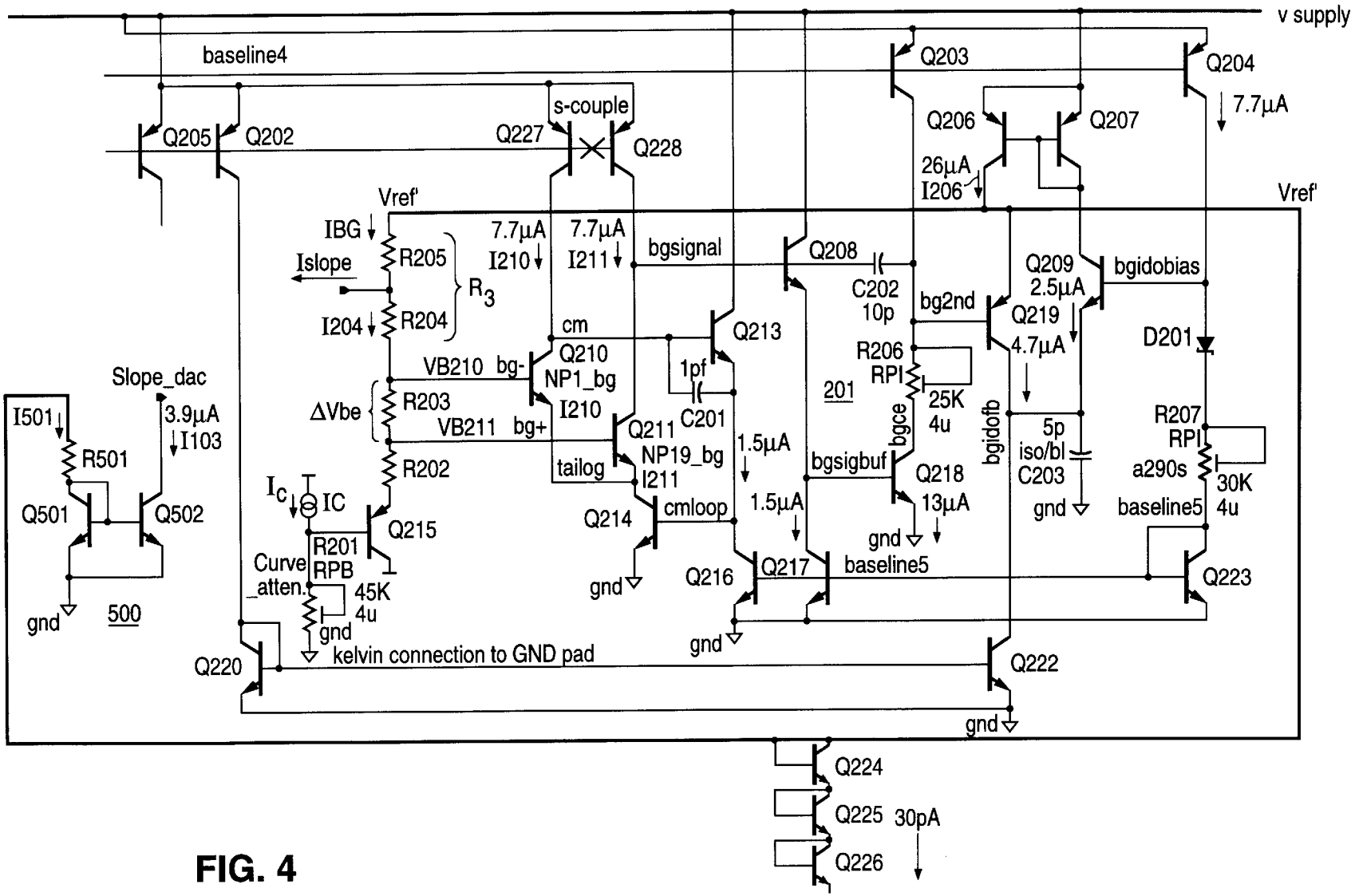
FIG. 4 is a more detailed circuit schematic of one embodiment of the circuit of FIG. 3.

Referring to FIG. 4, one embodiment of the circuit of FIG. 3 can be implemented as shown. In accordance with well-known bandgap circuit techniques, the emitter area of transistor Q211 is ten times the size of the emitter area of transistor Q210 in order to generate a positive temperature drift voltage across resistor R203. A "bootstrap" operational amplifier is formed by transistors Q210, Q211, Q214, Q213, Q208, Q218 and Q219. Transistor Q206 serves as a current source and the loop formed by transistors Q219, Q209, Q207 and Q206 forces transistor Q206 to source only that amount of bias current needed to generate the bandgap-based reference voltage Vref. Transistors Q202, Q222, Q227, Q228, Q203, Q204, Q217 and Q216 are also current sources. As discussed above, resistor R201 and the bias current $I_C$ cause the curvature correction voltage $V_C$ to be generated at the base of transistor Q215. A diode string formed by diode-connected transistors Q224, Q225 and Q226 prevents the circuit from latching up during the initial application of DC power.

As noted above, resistor R3 is formed with two resistors R204, R205 in series. By tapping off a current Islope from the intermediate node connecting these resistors R204, R205, the original incoming current IBG is reduced to a lessor value of current I204, thereby allowing for an adjustment in the effective value of this overall resistance R3.

Figure 5:
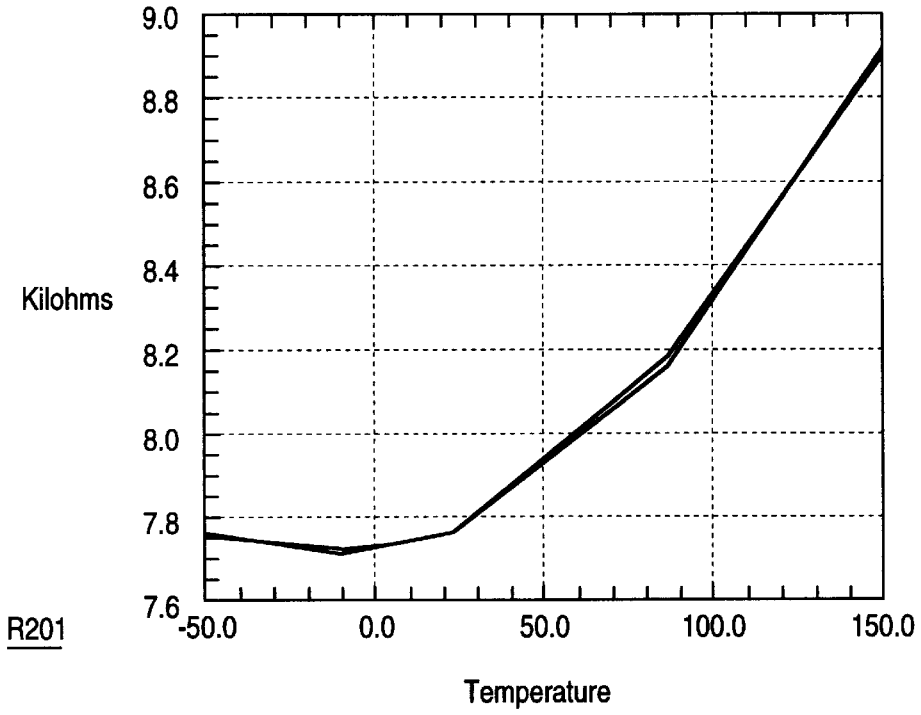
FIG. 5 is a graph of the resistance-versus-temperature characteristic of the resistor used for generating the curvature correction voltage in the circuit of FIG. 3.

Referring to FIG. 5, it can be seen that the resistance of resistor of R201 varies over temperature with a positive direction of incurvature. This resistor R201 is formed by the P-type diffusion that forms the base regions of NPN bipolar junction transistors.

Figure 6:
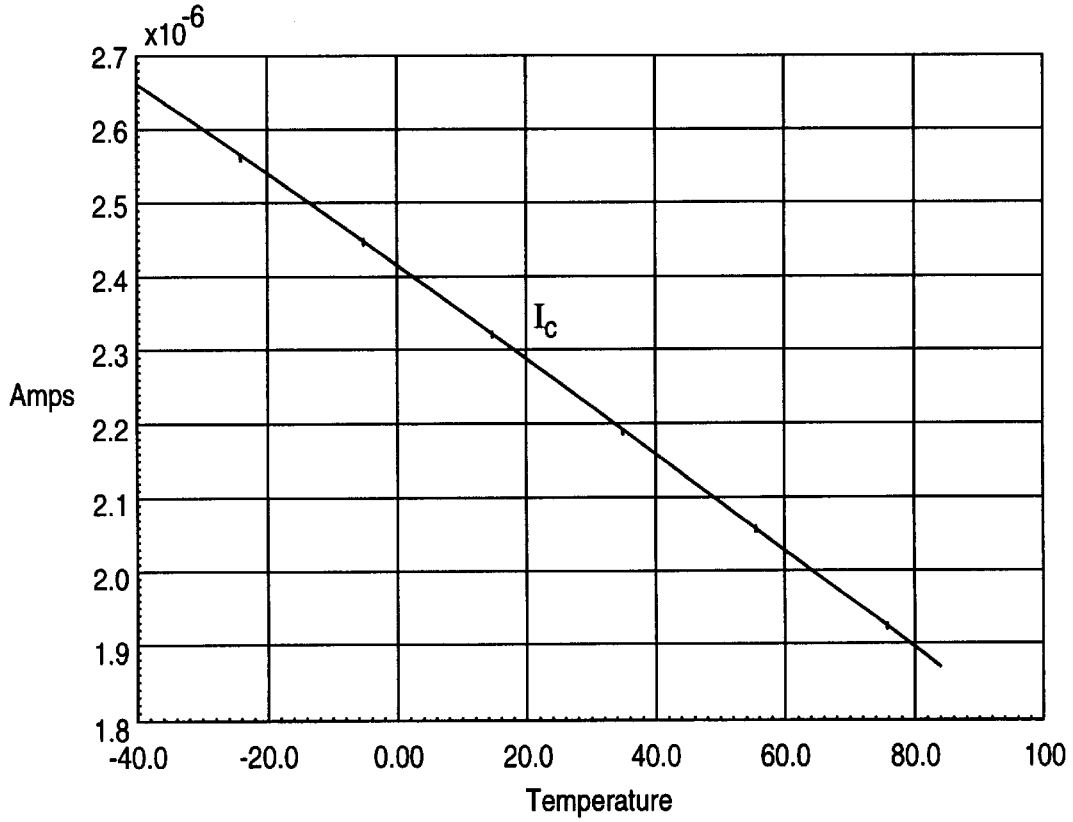
FIG. 6 is a graph of the current-versus-temperature characteristic of the source current used to generate the curvature correction voltage in the circuit of FIG. 3.

Referring to FIG. 6, it can be seen that the curvature correction current $I_C$ varies over temperature with a negative slope.

Figure 7:
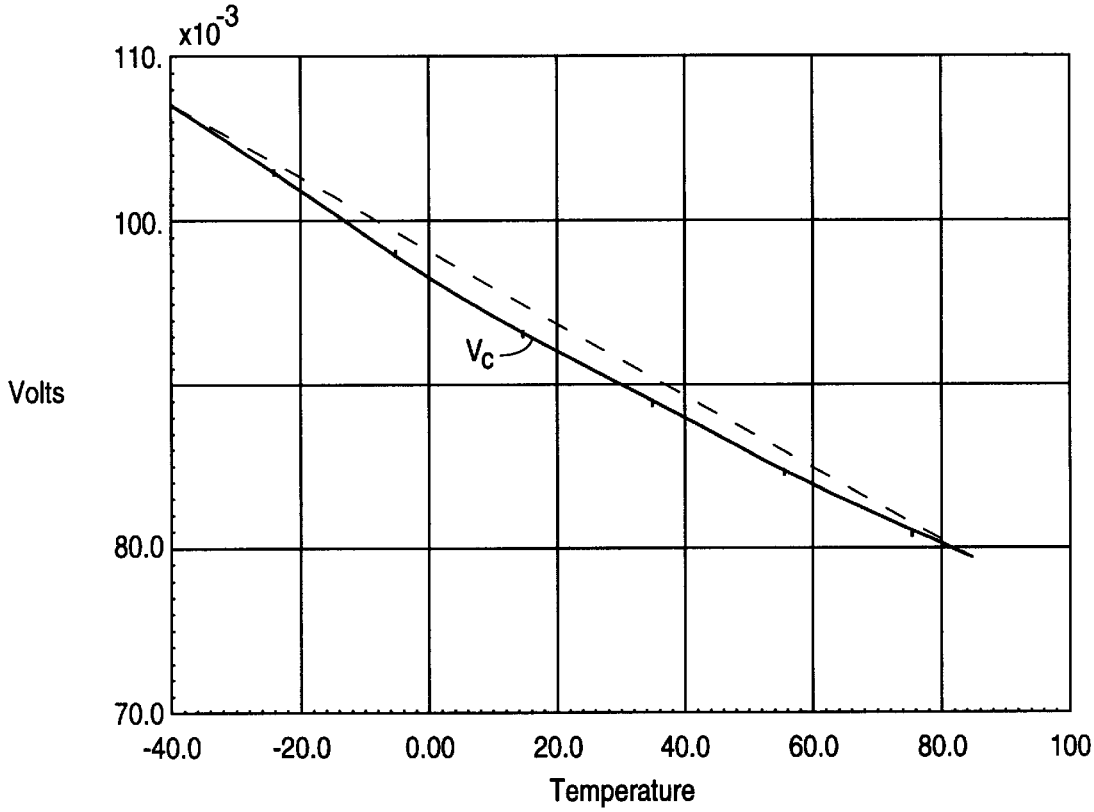
FIG. 7 is a graph of the voltage-versus-temperature characteristic for the curvature correction voltage generated in the circuit of FIG. 3.

Referring to FIG. 7, combining this curvature correction current $I_C$ with the resistance of resistor R201 produces a curvature correction voltage $V_C$ which also has a positive direction of incurvature. The slope, i.e., the first order temperature coefficient, of this product of correction current $I_C$ and resistance $R_C$ (i.e., R201) requires compensation by adjusting the first order slope of the "quasi" bandgap voltage Vbg' to have an equal but opposite slope, thereby producing a bandgap-based reference voltage Vref having a zero temperature coefficient. The net result of this compensation, due to the introduction of the correction voltage $V_C$ is a bandgap-based reference voltage Vref that is greater than the normal bandgap voltage Vbg by approximately 200 millivolts.

Figure 2:
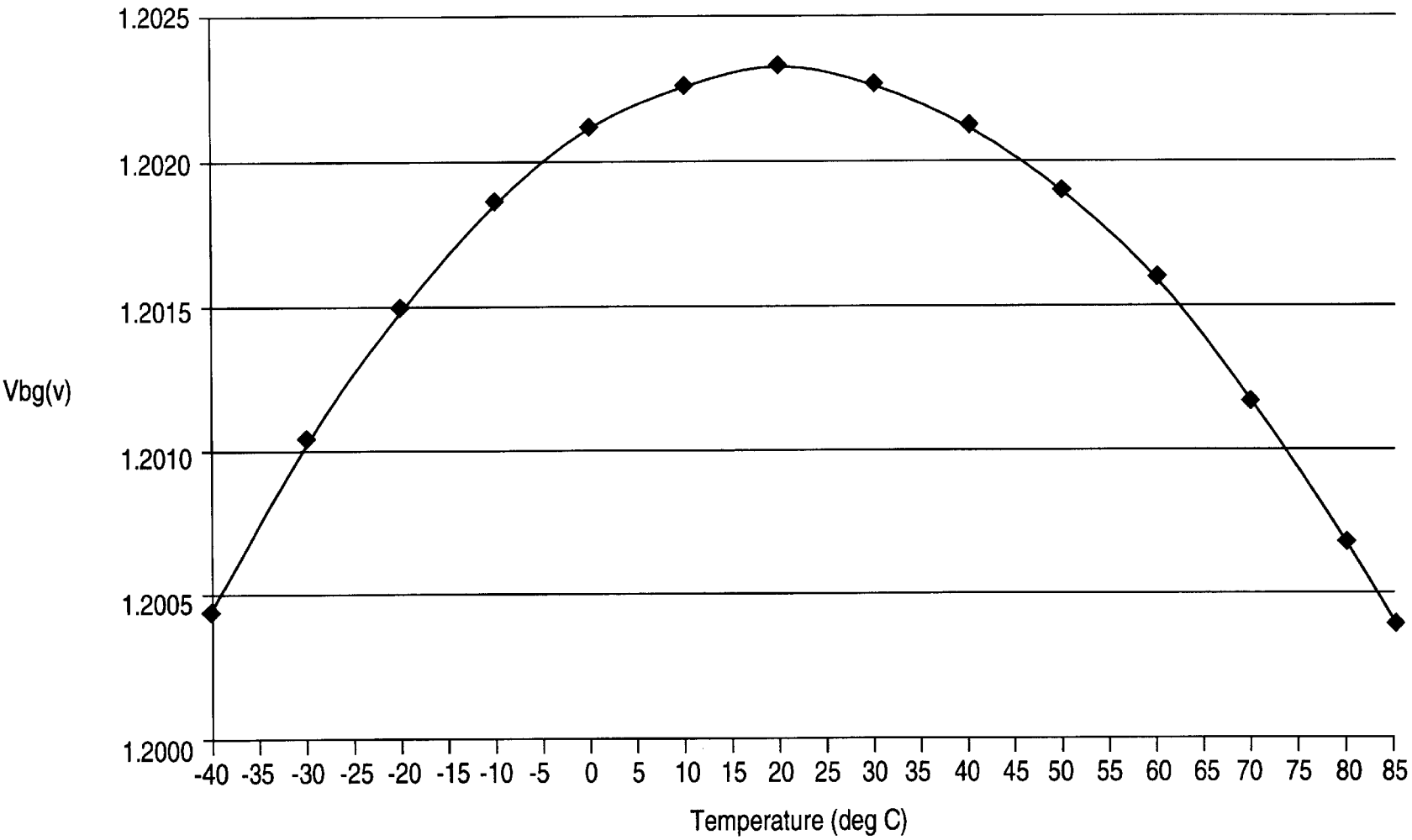
FIG. 2 (Prior Art)
FIG. 2 is a graph of the voltage-versus-temperature characteristic of the circuit of FIG. 1.
Figure 8:
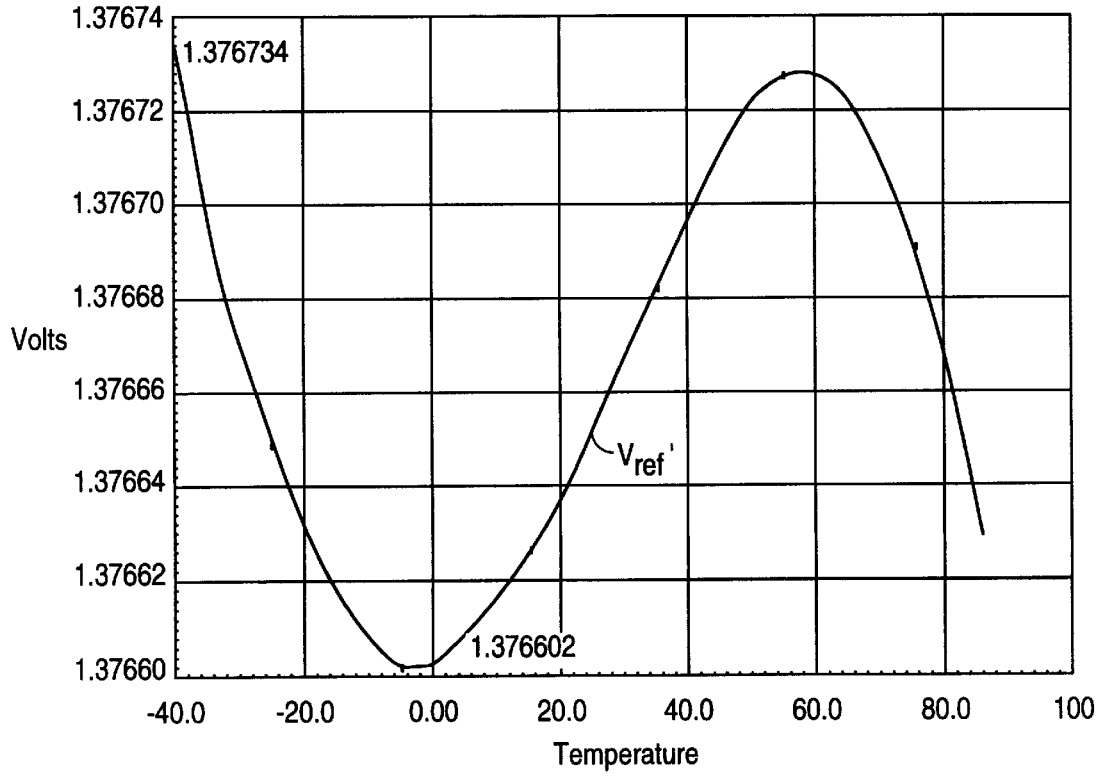
FIG. 8 is a graph of the voltage-versus-temperature characteristic of the bandgap-based reference voltage generated by the circuit of FIG. 3.

Referring to FIG. 8, the result of this compensation produces a bandgap-based reference voltage Vref which varies over temperature as shown. As can be seen, the temperature coefficient for this voltage Vref is approximately 0.77 ppm/° C. A comparison of this voltage variation (FIG. 8) with that shown in FIG. 2 reveals an improvement, i.e., reduction, in temperature coefficient by a factor of approximately 16.

One example of a host system for which a circuit in accordance with the present invention is well suited for use is the subject of commonly assigned and co-pending U.S. patent application Ser. No. 09/366,237entitled "Precision Voltage Reference Circuit With Temperature Compensation," filed on even date herewith, the disclosure of which is incorporated herein by reference.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a bandgap-based reference voltage generator circuit with an increased output reference voltage and a reduced temperature coefficient, comprising:

a bandgap voltage generator circuit that provides a bandgap-based reference voltage, receives a curvature correction control voltage and combines said bandgap-based reference voltage and said curvature correction control voltage to provide a quasi bandgap voltage with a first arcuate voltage-versus-temperature characteristic having a first direction of incurvature, wherein said bandgap voltage generator circuit comprises a bias voltage generator circuit that following reception of said curvature correction control voltage provides a bias voltage, wherein a voltage difference between said curvature correction control voltage and said bias voltage has a negative temperature coefficient, a voltage divider circuit, coupled to said bias voltage generator circuit, that following reception of said bias voltage and said bandgap-based reference voltage provides first and second intermediate voltages, wherein a difference between said bias voltage and said bandgap-based reference voltage comprises said quasi bandgap voltage, first and second circuit branches, coupled to said voltage divider circuit, that following reception of said first and second intermediate voltages conduct first and second substantially equal branch currents at first and second substantially unequal current densities and provide first and second branch voltages, respectively, wherein a voltage difference between said first and second intermediate voltages has a positive temperature coefficient, and a differential amplifier circuit, coupled to said first and second circuit branches and said voltage divider circuit, that following reception of said first and second branch voltages provides said bandgap-based reference voltage; and a control voltage generator circuit, coupled to said bandgap voltage generator circuit, that provides said curvature correction control voltage with a second arcuate voltage-versus-temperature characteristic having a second direction of incurvature which is substantially opposite said first direction of incurvature.

2. The apparatus of claim 1, wherein said bias voltage generator circuit comprises a bipolar junction transistor which includes:

a base terminal coupled to said control voltage generator circuit; and an emitter terminal coupled to said voltage divider circuit.

3. The apparatus of claim 1, wherein:

said voltage divider circuit includes first, second and third resistive circuit elements;

said first intermediate voltage is provided between said first and second resistive circuit elements; and said second intermediate voltage is provided between said second and third resistive circuit elements.

4. The apparatus of claim 1, wherein said first and second circuit branches include first and second bipolar junction transistors with first and second mutually scaled emitter terminal regions, respectively.

5. An apparatus including a bandgap-based reference voltage generator circuit with an increased output reference voltage and a reduced temperature coefficient, comprising:

a bandgap voltage generator circuit that provides a bandgap-based reference voltage, receives a curvature correction control voltage and combines said bandgap-based reference voltage and said curvature correction control voltage to provide a quasi bandgap voltage with a first arcuate voltage-versus-temperature characteristic having a first direction of incurvature, and a control voltage generator circuit, coupled to said bandgap voltage generator circuit, that provides said curvature correction control voltage with a second arcuate voltage-versus-temperature characteristic having a second direction of incurvature which is substantially opposite said first direction of incurvature, wherein said control voltage generator circuit comprises a current source circuit that provides a control current with a negative temperature coefficient, and a resistive circuit element, having a resistance with a positive temperature coefficient and coupled to said current source circuit, that following reception of said control current provides said curvature correction control voltage.

6. The apparatus of claim 5, wherein said current source circuit comprises:

a PN junction device that following reception of a first current generates a PN junction voltage;

a resistor, having a resistance and coupled to said PN junction device, that following reception of said PN junction voltage conducts a second current which is substantially equal to a quotient of said PN junction voltage and said resistance; and a current replication circuit, coupled to said resistor, that following reception of said second current provides said control current, wherein said control current is substantially proportional to said second current.

7. The apparatus of claim 6, wherein said PN junction device comprises a diode.

8. The apparatus of claim 6, wherein said PN junction device comprises a bipolar junction transistor.

9. The apparatus of claim 6, wherein said current replication circuit comprises a current mirror circuit.

10. The apparatus of claim 5, wherein said resistive circuit element comprises a resistor formed by a P-type diffusion within a semiconductor material.

11. A apparatus including a bandgap-based reference voltage generator circuit with an increased output reference voltage and a reduced temperature coefficient, comprising:

bandgap voltage generator means for providing a bandgap-based reference voltage, receiving a curvature correction control voltage and combining said bandgap-based reference voltage and said curvature correction control voltage to provide a quasi bandgap voltage with a first arcuate voltage-versus-temperature characteristic having a first direction of incurvature, wherein said bandgap voltage generator means comprises:

bias voltage generator means for receiving said curvature correction control voltage and providing a bias voltage, wherein a voltage difference between said curvature correction control voltage and said bias voltage has a negative temperature coefficient, voltage divider means, coupled to said bias voltage generator means, for receiving said bias voltage and said bandgap-based reference voltage and providing first and second intermediate voltages, wherein a difference between said bias voltage and said bandgap-based reference voltage comprises said quasi bandgap voltage, first and second circuit means, coupled to said voltage divider means, for receiving said first and second intermediate voltages and conducting first and second substantially equal branch currents at first and second substantially unequal current densities and providing first and second branch voltages, respectively, wherein a voltage difference between said first and second intermediate voltages has a positive temperature coefficient, and differential amplifier means, coupled to said first and second circuit means and said voltage divider means, for receiving said first and second branch voltages and providing said bandgap-based reference voltage; and control voltage generator means, coupled to said bandgap voltage generator means, for providing said curvature correction control voltage with a second arcuate voltage-versus-temperature characteristic having a second direction of incurvature which is substantially opposite said first direction of incurvature.

12. An apparatus including a bandgap-based reference voltage generator circuit with an increased output reference voltage and a reduced temperature coefficient, comprising:

bandgap voltage generator means for providing a bandgap-based reference voltage, receiving a curvature correction control voltage and combining said bandgap-based reference voltage and said curvature correction control voltage to provide a quasi bandgap voltage with a first arcuate voltage-versus-temperature characteristic having a first direction of incurvature; and control voltage generator means, coupled to said bandgap voltage generator means, for providing said curvature correction control voltage with a second arcuate voltage-versus-temperature characteristic having a second direction of incurvature which is substantially opposite said first direction of incurvature, wherein said control voltage generator means comprises current source means for providing a control current with a negative temperature coefficient, and resistive circuit means, having a resistance with a positive temperature coefficient and coupled to said current source means, for receiving said control current and providing said curvature correction control voltage.

13. The apparatus of claim 12, wherein said current source means comprises:

PN junction means for receiving a first current and generating a PN junction voltage;

resistive means, having a resistance and coupled to said PN junction means, for receiving said PN junction voltage and conducting a second current which is substantially equal to a quotient of said PN junction voltage and said resistance; and current replication means, coupled to said resistive means, for receiving said second current and providing said control current, wherein said control current is substantially proportional to said second current.

14. An apparatus including a bandgap-based reference voltage generator circuit with an increased output reference voltage and a reduced temperature coefficient, comprising:

a bias voltage generator circuit that following reception of a curvature correction control voltage provides a bias voltage, wherein a voltage difference between said curvature correction control voltage and said bias voltage has a negative temperature coefficient;

a voltage divider circuit, coupled to said bias voltage generator circuit, that following reception of said bias voltage and a bandgap-based reference voltage provides first and second intermediate voltages, wherein a difference between said bias voltage and said bandgap-based reference voltage comprises a quasi bandgap voltage;

first and second circuit branches, coupled to said voltage divider circuit, that following reception of said first and second intermediate voltages conduct first and second substantially equal branch currents at first and second substantially unequal current densities and provide first and second branch voltages, respectively, wherein a voltage difference between said first and second intermediate voltages has a positive temperature coefficient;

a differential amplifier circuit, coupled to said first and second circuit branches and said voltage divider circuit, that following reception of said first and second branch voltages provides said bandgap-based reference voltage;

a current source circuit that provides a control current with a negative temperature coefficient; and a resistive circuit element, having a resistance with a positive temperature coefficient and coupled to said current source circuit and said bias voltage generator circuit, that following reception of said control current provides said curvature correction control voltage;

wherein said quasi bandgap voltage has a first arcuate voltage-versus-temperature characteristic with a first direction of incurvature and said curvature correction control voltage has a second arcuate voltage-versus-temperature characteristic with a second direction of incurvature which is substantially opposite said first direction of incurvature.

15. The apparatus of claim 14, wherein said bias voltage generator circuit comprises a bipolar junction transistor which includes:

a base terminal coupled to said resistive circuit element; and an emitter terminal coupled to said voltage divider circuit.

16. The apparatus of claim 14, wherein:

said voltage divider circuit includes first, second and third resistive circuit elements;

said first intermediate voltage is provided between said first and second resistive circuit elements; and said second intermediate voltage is provided between said second and third resistive circuit elements.

17. The apparatus of claim 14, wherein said first and second circuit branches include first and second bipolar junction transistors with first and second mutually scaled emitter terminal regions, respectively.

18. The apparatus of claim 14, wherein said current source circuit comprises:

a PN junction device that following reception of a first current generates a PN junction voltage;

a resistor, having a resistance and coupled to said PN junction device, that following reception of said PN junction voltage conducts a second current which is substantially equal to a quotient of said PN junction voltage and said resistance; and a current replication circuit, coupled to said resistor, that following reception of said second current provides said control current, wherein said control current is substantially proportional to said second current.

19. The apparatus of claim 18, wherein said PN junction device comprises a diode.

20. The apparatus of claim 18, wherein said PN junction device comprises a bipolar junction transistor.

21. The apparatus of claim 18, wherein said current replication circuit comprises a current mirror circuit.

22. The apparatus of claim 14, wherein said resistive circuit element comprises a resistor formed by a P-type diffusion within a semiconductor material.

23. An apparatus including a bandgap-based reference voltage generator circuit with an increased output reference voltage and a reduced temperature coefficient, comprising:

bias voltage generator means for receiving a curvature correction control voltage and providing a bias voltage, wherein a voltage difference between said curvature correction control voltage and said bias voltage has a negative temperature coefficient;

voltage divider means, coupled to said bias voltage generator means, for receiving said bias voltage and a bandgap-based reference voltage and providing first and second intermediate voltages, wherein a difference between said bias voltage and said bandgap-based reference voltage comprises a quasi bandgap voltage;

first and second circuit means, coupled to said voltage divider means, for receiving said first and second intermediate voltages and conducting first and second substantially equal branch currents at first and second substantially unequal current densities and providing first and second branch voltages, respectively, wherein a voltage difference between said first and second intermediate voltages has a positive temperature coefficient;

differential amplifier means, coupled to said first and second circuit means and said voltage divider means, for receiving said first and second branch voltages and providing said bandgap-based reference voltage;

current source means for providing a control current with a negative temperature coefficient; and resistive circuit means, having a resistance with a positive temperature coefficient and coupled to said current source means and said bias voltage generator means, for receiving said control current and providing said curvature correction control voltage;

wherein said quasi bandgap voltage has a first arcuate voltage-versus-temperature characteristic with a first direction of incurvature and said curvature correction control voltage has a second arcuate voltage-versus-temperature characteristic with a second direction of incurvature which is substantially opposite said first direction of incurvature.

24. The apparatus of claim 23, wherein said current source means comprises:

PN junction means for receiving a first current and generating a PN junction voltage;

resistive means, having a resistance and coupled to said PN junction means, for receiving said PN junction voltage and conducting a second current which is substantially equal to a quotient of said PN junction voltage and said resistance; and current replication means, coupled to said resistive means, for receiving said second current and providing said control current, wherein said control current is substantially proportional to said second current.

* * * * *